US011772233B2

(12) United States Patent
Rohrer et al.

(10) Patent No.: US 11,772,233 B2
(45) Date of Patent: Oct. 3, 2023

(54) GRINDING ROBOT AND METHOD FOR GRINDING ELECTRICALLY CONDUCTIVE WORKPIECES

(71) Applicant: Voith Patent GmbH, Heidenheim (DE)

(72) Inventors: Martin Rohrer, St. Veit/Gölsen (AT); Florian Weigl, St. Martin (AT); Stefan Karner, Blindenmarkt (AT)

(73) Assignee: Voith Patent GmbH, Heidenheim (DE)

( * ) Notice: Subject to any disclaimer, the term of this patent is extended or adjusted under 35 U.S.C. 154(b) by 1106 days.

(21) Appl. No.: 16/519,992

(22) Filed: Jul. 23, 2019

(65) Prior Publication Data

US 2019/0344400 A1 Nov. 14, 2019

Related U.S. Application Data

(63) Continuation of application No. PCT/EP2017/081302, filed on Dec. 4, 2017.

(30) Foreign Application Priority Data

Jan. 23, 2017 (DE) ..... 10 2017 101 175.7

(51) Int. Cl.
*B24B 49/10* (2006.01)
*B24B 41/04* (2006.01)
(Continued)

(52) U.S. Cl.
CPC ..... *B24B 49/10* (2013.01); *B24B 1/002* (2013.01); *B24B 41/002* (2013.01); *B24B 41/04* (2013.01); *B24B 49/183* (2013.01); *B24D 5/00* (2013.01)

(58) Field of Classification Search
CPC ... B24D 5/00; B24D 5/02; B24D 5/04; B24D 5/12; B24D 7/02; B24D 7/04; B24D 7/18;
(Continued)

(56) References Cited

U.S. PATENT DOCUMENTS 2,947,121 A * 8/1960 Coes, Jr. ..... B23Q 15/10 451/541
4,137,516 A 1/1979 Shaw et al.
(Continued)

FOREIGN PATENT DOCUMENTS

CN 103056759 A 4/2013
EP 0 421 323 A1 10/1990
(Continued)

OTHER PUBLICATIONS

Notice of Transmission of the International Research Report and the Written Notice Issued the International Searching Authority or Declaration dated Apr. 20, 2018 for International Application No. PCT/EP2017/081302 (15 pages).
German Office Action dated Oct. 25, 2017 for German Application No. 10 2017 101 175.7 (10 pages).

*Primary Examiner* — Eileen P Morgan
(74) *Attorney, Agent, or Firm* — Taylor IP, P.C.

(57) ABSTRACT

A grinding robot for grinding an electrically conducting workpiece. The grinding robot includes a grinding wheel, an actuation device for actuating grinding wheel, and a control system. The grinding wheel including an undulated tool receptacle which defines an axis of rotation about which the grinding wheel can rotate during grinding, and a head which is rotationally symmetrical with respect to the axis of rotation, and which contains abrasive material and has a grinding surface which is in contact with workpiece during grinding. The grinding wheel also includes a measuring and transmission unit and at least one conductor strand pair with two conductor strands which are electrically insulated from one another. The conductor strands are embedded in the rotationally symmetrical head and extend from the grinding surface of the head into the interior of the head and are electrically connected with measuring and transmission unit.

20 Claims, 4 Drawing Sheets

(51) Int. Cl.

| | |
|---|---|
| ***B24D 5/04*** | (2006.01) |
| ***B24D 7/18*** | (2006.01) |
| ***B24D 5/00*** | (2006.01) |
| ***B24B 49/18*** | (2006.01) |
| ***B24B 41/00*** | (2006.01) |
| ***B24B 1/00*** | (2006.01) |

(58) Field of Classification Search

CPC ..... B24B 49/10; B24B 49/105; B24B 49/12; B24B 49/14; B24B 49/16; B24B 49/183; B24B 37/005; B24B 37/013; B24B 37/046; B24B 1/002; B24B 41/002; B24B 41/04; G06K 19/0723; G06K 19/045

USPC ..... 451/178, 259

See application file for complete search history.

(56) References Cited

U.S. PATENT DOCUMENTS

| | | | | |
|---|---|---|---|---|
| 4,674,235 | A | 6/1987 | Inoue | |
| 6,430,909 | B1 * | 8/2002 | Clauss | A01F 29/22 56/250 |
| 2015/0148937 | A1 | 5/2015 | Wolf | |
| 2021/0023675 | A1 * | 1/2021 | Mandl | B24B 47/18 |

FOREIGN PATENT DOCUMENTS

| | | | | |
|---|---|---|---|---|
| GB | 891680 | | 3/1962 | |
| JP | 03264265 | | 11/1991 | |
| JP | H03264265 | A * | 11/1991 | |
| JP | H1034541 | A * | 2/1998 | |
| WO | WO-2020028855 | A1 * | 2/2020 | B24B 49/10 |

* cited by examiner

GRINDING ROBOT AND METHOD FOR GRINDING ELECTRICALLY CONDUCTIVE WORKPIECES

CROSS REFERENCE TO RELATED APPLICATIONS

This is a continuation of PCT application No. PCT/EP2017/081302, entitled "GRINDING ROBOT FOR GRINDING ELECTRICALLY CONDUCTIVE WORKPIECES, AND METHOD FOR OPERATING SAME", filed Dec. 4, 2017, which is incorporated herein by reference.

BACKGROUND OF THE INVENTION

1. Field of the Invention

The present invention relates to a grinding robot for grinding electrically conductive workpieces, and a method for operating a grinding robot.

2. Description of the Related Art

Grinding robots are known from the current state of the art. The approach of the grinding wheel toward the workpiece is controlled by measuring of the position of the grinding wheel in the direction toward the workpiece, and by measuring the force which is being exerted by the workpiece upon the grinding wheel. EP 0 421 323 A1 discloses a grinding wheel which is controlled by measuring the force exerted by the workpiece upon the grinding wheel.

Measurement of the specified factors may be difficult in practice. Moreover, the grinding wheel wears during operation. In known grinding robots this remains unrecognized and thus reduces the accuracy of the grinding result.

What is needed in the art is a grinding robot with more accurate grinding results.

SUMMARY OF THE INVENTION

The present invention provides a grinding robot for grinding electrically conductive workpieces wherein the control of the grinding process in normal operation occurs exclusively by measuring electrical values.

The present invention also provides a grinding robot for grinding an electrically conducting workpiece including a grinding wheel. The grinding wheel includes an undulated tool receptacle which defines an axis of rotation about which the grinding wheel can rotate during grinding, a head which is rotationally symmetrical with respect to the axis of rotation, and the head contains abrasive material and has a grinding surface that is configured for contacting the workpiece during grinding, a measuring and transmission unit, and at least one conductor strand pair including two conductor strands which are electrically insulated from one another. The conductor strands are embedded in the head and extend from the grinding surface of the head into an interior of the head and are electrically connected with the measuring and transmission unit. The grinding robot further includes an actuation device for actuating the grinding wheel, and a control system which is connected with the actuation device and which controls the grinding wheel. The conductor strands are arranged in such a way that during grinding, due to the contact with the workpiece, a closed electrical circuit is created for measuring a resistance value, wherein the electric circuit progresses from the measuring and transmission unit via one conductor strand, the workpiece, and the other conductor strand back to the measuring and transmission unit, and the conductor strands are designed in such a way that a measured resistance is dominated by a resistance of conductor strands, so that the measured resistance is a reciprocal proportional measurement for a degree of wear of the head. The measuring and transmission unit is configured for measuring and transmitting the measured resistance to the control system and wherein the control system is configured for considering the measured resistance in determining whether a predefined surface contour of the workpiece has been achieved.

The present invention also provides a method for grinding an electrically conducting workpiece. The method includes an initial step of providing a grinding robot for grinding the electrically conducting workpiece. The grinding robot includes a grinding wheel, the grinding wheel includes an undulated tool receptacle which defines an axis of rotation about which the grinding wheel can rotate during grinding, a head which is rotationally symmetrical with respect to the axis of rotation, and the head contains abrasive material and has a grinding surface that is configured for contacting the workpiece during grinding, a measuring and transmission unit, and at least one conductor strand pair including two conductor strands which are electrically insulated from one another. The conductor strands are embedded in the head and extend from the grinding surface of the head into an interior of the head and are electrically connected with the measuring and transmission unit. The grinding robot also includes an actuation device for actuating the grinding wheel, and a control system which is connected with the actuation device and which controls the grinding wheel. The conductor strands are arranged in such a way that during grinding, due to the contact with the workpiece, a closed electrical circuit is created for measuring a resistance value, wherein the electric circuit progresses from the measuring and transmission unit via one conductor strand, the workpiece, and the other conductor strand back to the measuring and transmission unit, and the conductor strands are designed in such a way that a measured resistance is dominated by a resistance of conductor strands, so that the measured resistance is a reciprocal proportional measurement for a degree of wear of the head, and wherein the measuring and transmission unit is configured for measuring and transmitting the measured resistance to the control system and wherein the control system is configured for considering the measured resistance in determining whether a predefined surface contour of the workpiece has been achieved. The method further includes the steps of moving the grinding wheel toward the workpiece until the grinding wheel is in contact with the workpiece, and processing of the workpiece by the grinding wheel until a predefined surface contour on the workpiece is achieved. The control system terminates the moving step and transitions to the processing step as soon as it has received the resistance value from the measuring and transmission unit, and wherein in the processing step the measuring and transmission unit constantly transmits the resistance value to the control system which considers the resistance value in determining whether the predefined surface contour has been achieved.

A grinding robot uses a grinding wheel to remove material from the surface of a workpiece, for example in order to form the hydraulic contour in the case of cast blades on an impeller for a hydraulic machine. In order to avoid a time-consuming procedure for approach it is necessary for the grinding robot to be able to determine when the grinding wheel makes contact with the work piece. Since the grinding wheel experiences wear during operation, causing a reduction in the diameter of the head, the grinding robot should moreover be continuously informed regarding the current head diameter, so that it can produce the desired contour of the workpiece within specified tolerances. With conventional grinding bodies the current head diameter can only be estimated during operation, for example over the duration of a respective operating period. For the narrow tolerances of the aforementioned hydraulic contours such estimation is however too inaccurate.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate embodiments of the invention and such exemplifications are not to be construed as limiting the scope of the invention in any manner.

DETAILED DESCRIPTION OF THE INVENTION

Figure 1:
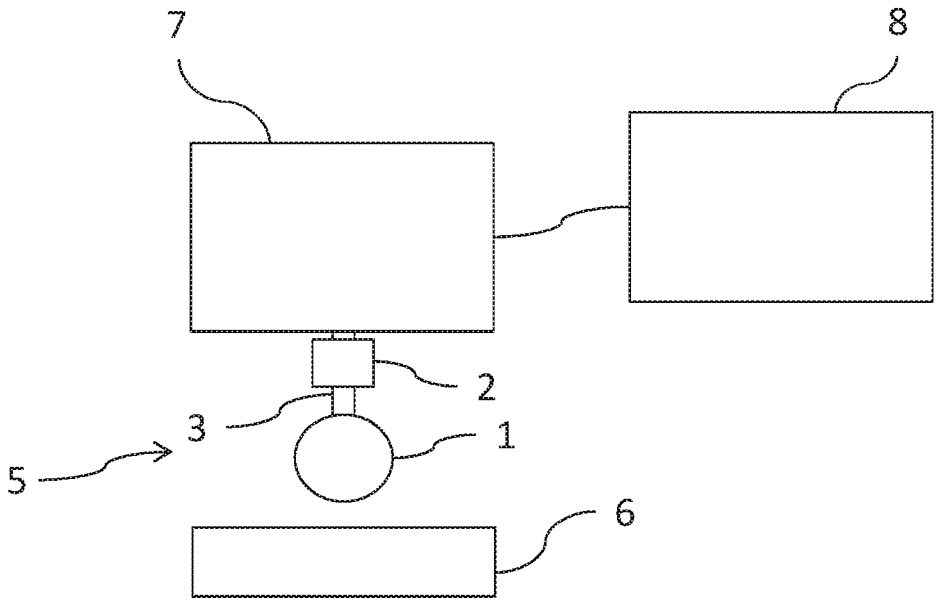
FIG. 1 is a schematic view of a grinding robot according to the present invention.

Referring now to the drawings, and more particularly to FIG. 1, there is shown a schematic illustration of a grinding robot according to the present invention. The grinding robot is suitable for automatic grinding of an electrically conductive workpiece 6. The grinding robot comprises a grinding wheel 5 that includes a rotationally symmetrical head 1, a tool receptacle 3 and a measuring and transmission unit 2. The grinding robot furthermore includes an actuation device 7 for actuation of grinding wheel 5. The actuation device 7 of grinding wheel 5 includes on the one hand the support and rotation of grinding wheel 5 by way of tool receptacle 3. It also includes the approach and pressing of grinding wheel 5 against workpiece 6, wherein head 1 of grinding wheel 5 makes contact with the workpiece 6. Device 7 for actuation of grinding wheel 5 may for example include a robot arm. The grinding robot is connected with device 7 for activation of grinding wheel 5 and controls the same, wherein it uses data which is produced by measuring and transmission unit 2 and which is transmitted to the control unit.

Figure 2:
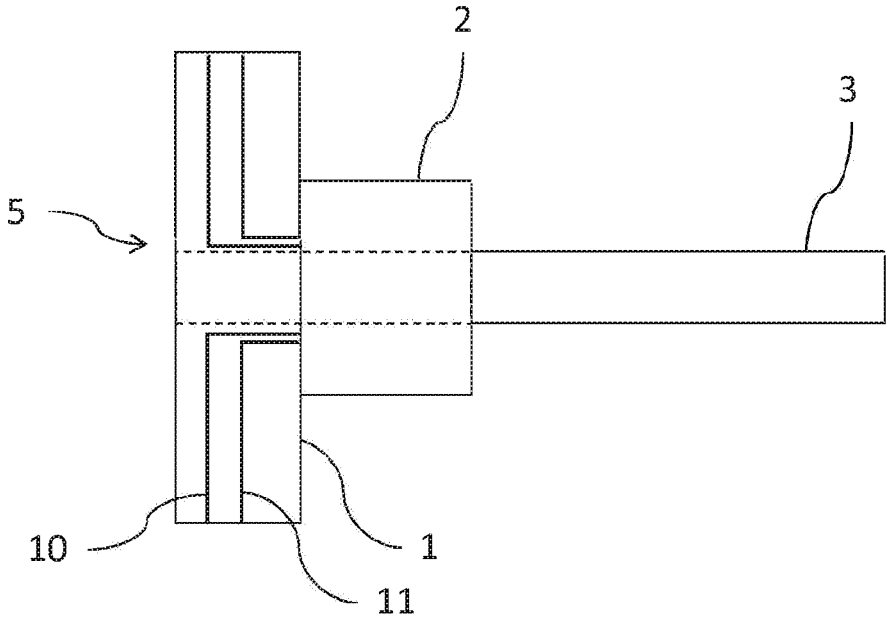
FIG. 2 is a sectional view taken along the rotational axis of a first embodiment of a grinding wheel for use in a grinding robot according to the present invention.

FIG. 2 illustrates a grinding wheel 5 for use in an inventive grinding robot in a first embodiment, along the axis of rotation. During operation, the grinding wheel 5 rotates around tool receptacle 3. Grinding wheel 5 also includes a measuring and transmission unit 2. The measuring and transmission unit 2 is equipped with an independent power supply, which can be for example a battery or a super capacitor (not illustrated). At least two conductor strands 10 and 11 are embedded into the rotationally symmetrical head 1. The conductor strands 10 and 11 extend in each case from the outer surface of rotationally symmetrical head 1 which is in contact with workpiece 6 during operation, to the interior of head 1 where they are electrically connected with measuring and transmission unit 2. The conductor strands 10 and 11 are electrically insulated from one another, which is achieved either by a separation of the conductor strands 10, 11 from one another or through electrical insulation of the same.

Figure 3:
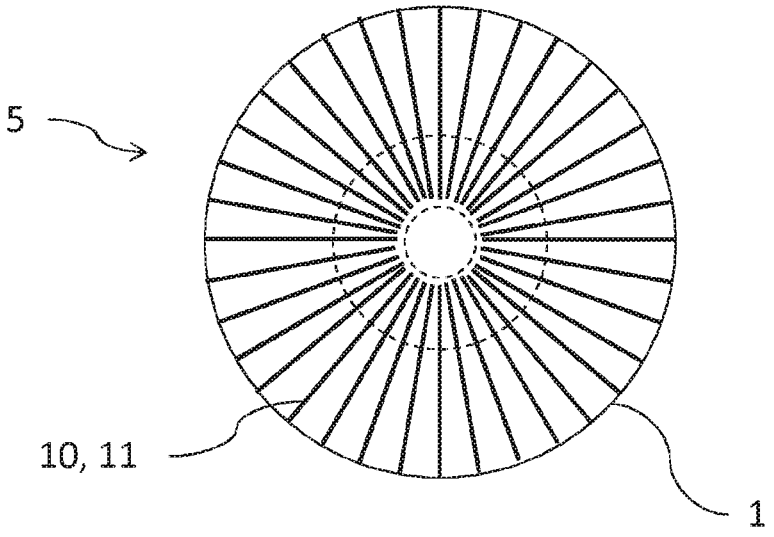
FIG. 3 is a sectional view taken transversely to the rotational axis of a first embodiment of a grinding wheel for use in a grinding robot according to the present invention.

FIG. 3 shows the same embodiment of grinding wheel 5 as is shown in FIG. 1 in a sectional view, transverse to the rotational axis. It can be seen that conductor strands 10 and 11 are arranged behind each other and progress radially from the cylindrical outside surface of head 1 into the interior of the same.

Grinding wheel 5 in FIGS. 2 and 3 is designed so that, during operation, the cylindrical outside surface of head 1 is in contact with electrically conductive workpiece 6. In suitable rotary positions of grinding head 1, an electrical connection is established during operation—due to the contact of the conductive workpiece 6—between the stands of one conductor pair 10 and 11, so that an electric circuit is created which progresses from measuring and transmission unit 2 via conductor stand 10, workpiece 6 and conductor strand 11 back to measuring and transmission unit 2 (or vice versa). This electric circuit is used by measuring and transmission unit 2 for resistance measurement. The conductor strands 10, 11 are designed in such a way that the measured resistance is dominated by the resistance of the conductor strands 10, 11. If grinding wheel 5 wears during operation, the diameter of head 1 decreases with the result that conductor strands 10, 11 become accordingly shorter which in turn results in that the measured resistance becomes smaller. The measured resistance is thus a reciprocal proportional measurement for the degree of wear of grinding head 1 of grinding wheel 5. The measuring and transmission unit 2 is designed for the transmission of the measured resistance values and thus of the degree of wear to control system 8. Transmission can occur, for example through Bluetooth. The signals received by control system 8 are used for control of the grinding process in order to produce the desired contour on the workpiece. If head 1 is not in contact with workpiece 6, no closed electric circuit exists, and no current can flow through conductor strands 10 and 11. In this case, measurement and transmission unit 2 transmits no resistance value to control system 8. Instead, the measuring and transmission unit can transmit another signal to control system 8. This signal or rather the non-existence of a resistance signal is used by control system 8 for the approach process of grinding wheel 5 toward workpiece 6.

The arrangement of conductor strands 10, 11 illustrated in FIGS. 2 and 3 is only one of many possible arrangements. The radial progression herein may be especially simple and thus advantageous for the production of a grinding wheel 5 for use in a grinding robot according to the present invention. Alternatively, conductor strands in FIG. 3 could also progress spirally inward or—in FIG. 2—not be positioned perpendicular relative to the cylindrical surface, but instead diagonally or curved. The only requirement is that the conductor strands 10, 11 constantly reduce with the expected wear of head 1, so that the decrease in the conductor strand length represents a constant measurement for the degree of wear. The measured dimension for the degree of wear is therefore inversely proportional to the degree of wear.

FIG. 3 shows a multitude of conductor strands 10, 11. As the grinding wheel 5 rotates very rapidly during operation, much fewer such pairs are sufficient for period resistance measurement, since each pair repeatedly passes the electrically conductive workpiece. For provision of the functionality according to the invention, just one conductor strand pair 10, 11 is sufficient. In contrast, use of too many conductor strand pairs 10, 11 could potentially be disadvantageous, since in such a case more than one conductor strand pair could, at the same time be in contact with the workpiece (if for example, the surface of workpiece 6 is accordingly curved), resulting in several electric circuits being closed at the same time. This problem can however be considered in that such circumstances are recognized and considered by an appropriately designed measuring and transmission unit 2, or more simply by using fewer pairs of conductor strands 10, 11.

Figure 4:
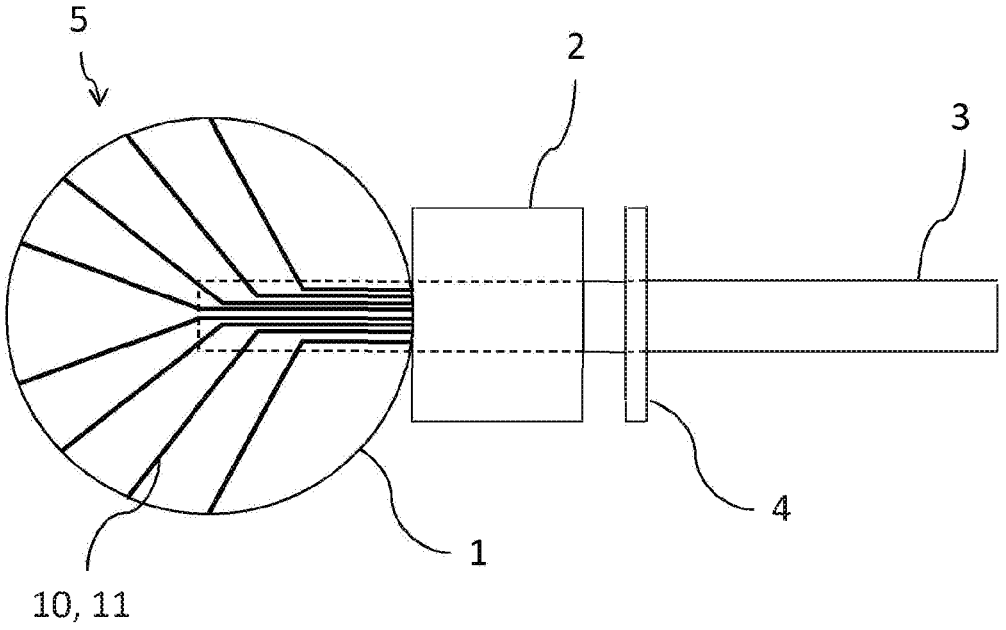
FIG. 4 is a sectional view taken along the rotational axis of a second embodiment of a grinding wheel for use in a grinding robot according to the present invention.

FIG. 4 illustrates a sectional view along the rotational axis of a second embodiment of a grinding wheel 5 for use in an inventive grinding robot. The same identification references are used as in FIGS. 1-3. Grinding wheel 5 illustrated in FIG. 4 has a rotationally symmetric head 1 which has a spherical shape. Since such a head 1 makes rather selective contact with the workpiece, conductor strand pairs 10, 11 must run much closer adjacent to one another onto the surface of head 1 and must progress closely together in the expected region of wear of head 1. Thus, conductor strand pairs 10, 11 are shown in each case in FIG. 4 only as a single line. It is clear that as a rule, this arrangement necessitates that conductor strands 10 are electrically insulated from conductor strands 11. One option for achieving this is in the use of coaxial cables which are insulated from one another, that is to say, one of conductor strands 10 or 11 surrounds the other one in a tubular manner, wherein a suitable insulating material is disposed between inside and outside conductor. Equally, both strands 10 and 11 can also progress parallel wherein insulating material is disposed between them.

With a grinding wheel that is configured as shown in FIG. 4 it is to be expected that the same will not wear isotropically. Rather, the sections of head 1 located laterally of the axis will presumably wear sooner than the sections at the front, in the region of the interface of the axis of rotation with the surface of head 1. It may therefore be advantageous if conductor strand pairs 10, 11 are provided that lead to different wear regions of the surface of head 1 and if measuring and transmission unit 2 can distinguish between the pairs 10, 11. In this way, control system 8 can also be informed regarding such anisotropic wear.

The inventive embodiment in FIG. 4 moreover comprises an optional device for measuring a possibly occurring bending of tool receptacle 3. Such a device can be advantageous should a malfunction occur during operation, in the electrical contact between workpiece and conductor strands 10, 11. In this case, control system 8 receives the permanent feedback from measuring and transmission unit 2 that no closed electric circuit is available and that therefore, no resistance measurement can occur. Since a current resistance signal also informs control system 8 regarding the current contact of the grinding wheel with the workpiece, control system 8 would assume that contact is not yet made and would thus try to advance grinding wheel 5 closer toward workpiece 6. This would increase the pressure upon grinding wheel 5, which however is already in contact with the workpiece. This would result in increased bending of tool receptacle 3. If such a situation is not intercepted, the result could be that far too much material is removed from workpiece 6 and that workpiece 6 would thus be considered to be outside of tolerance. This can be prevented through monitoring the bending in tool receptacle 3. The device for measuring the bend of tool receptacle 3 in FIG. 4 also includes a disc which is located on tool receptacle 3 and is identified with reference number 4. There is a suitable distance between disc 4 and measuring and transmission unit 2; and measuring and transmission unit 2 is equipped with one or more suitable sensors which can measure the distance at several locations around the circumference of the disc. Measuring and transmission unit 2 also transmits these measured values to control system 8. If tool receptacle 3 bends only slightly, one or several of the measured distances would change. If bending is detected during the approach of grinding wheel 5 toward workpiece 6 (in other words, before a resistance value can be measured) which exceeds a predefined threshold, an error message is created, and grinding wheel 5 is removed from workpiece 6 by way of device 7. It is obvious that the described optional device for measuring a potentially occurring bending of tool receptacle 3 can be utilized in all conceivable embodiments of a grinding wheel 5 for use in conjunction with an inventive grinding robot and that it is not restricted to the embodiment specified in FIG. 4.

Measurement of the distance between disc 4 and measurement and transmission unit 2 can occur for example by way of optical, mechanical, capacitive or inductive sensors.

It is clear from the above description that the arrangement of conductor strand pairs 10, 11 and evaluation of the same in measuring and transmission unit 2 must always be adapted to the geometry of rotationally symmetrical head 1 and the expected wear of the same. All common shapes are considered suitable shapes for rotationally symmetrical head 1 (i.e. cones, semi-rounded cylinders, etc.).

As a material for conductor strands 10, 11 graphite or carbon fiber are considered suitable. However, other materials offering a suitable specific resistance can also be used.

Figure 5:
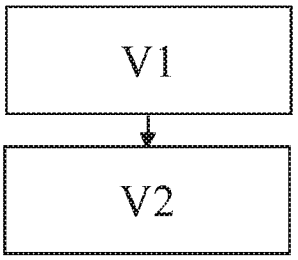
FIG. 5 illustrates a method to operate a grinding robot according to the present invention.

FIG. 5 shows a method for operating a grinding robot according to the present invention. The method comprises two process steps which are identified with V1 and V2. In step V1, grinding wheel 5 is moved toward workpiece 6 unit grinding wheel 5 makes contact with the workpiece. Measuring and transmission unit 2 delivers a signal to control system 8 which indicates that no electric circuit is closed via a conductor strand pair, as long as no contact exists between grinding wheel 5 and workpiece 6. As soon as a contact is established, at least one electric circuit is closed via a conductor strand pair, thereby enabling a resistance measurement. Measuring and transmission unit 2 delivers the measured resistance values to control system 8, whereupon the control system terminates approach step V1. In principle, measuring and transmitting unit 2 can also not transmit a signal as long as there is no contact. In this case, approach step V1 is terminated by control system 8 as soon as measuring and transmission unit 2 has transmitted a measured resistance value to control system 8. In subsequent step V2, workpiece 6 is processed until the desired surface contour has been achieved, whereby measuring and transmission unit 2 continuously transmits the measured resistance values to control system 8 which in turn considers these values in its decision of whether or not the desired surface contour has been achieved. This is facilitated by the fact that—as described above—the measured resistance values contain the information regarding the current degree of wear on grinding wheel 5. The constant transmission of the measured resistance values can also occur intermittently. In other words, measuring and transmission unit 2 transmits resistance value at such time when a predefined constant time interval has passed. The time interval is defined according to the expected wear per time unit and the required surface accuracy is defined in advance. The narrower the surface tolerance, the shorter a time interval must be selected.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A grinding robot for grinding an electrically conducting workpiece, comprising:

a grinding wheel, including:

an undulated tool receptacle which defines an axis of rotation about which the grinding wheel can rotate during grinding;

a head which is rotationally symmetrical with respect to the axis of rotation, and the head contains abrasive material and has a grinding surface that is configured for contacting the workpiece during grinding;

a measuring and transmission unit; and at least one conductor strand pair including two conductor strands which are electrically insulated from one another, the conductor strands are embedded in the head and extend from the grinding surface of the head into an interior of the head and are electrically connected with the measuring and transmission unit, an actuation device for actuating the grinding wheel; and a control system which is connected with the actuation device and which controls the grinding wheel, wherein the conductor strands are arranged in such a way that during grinding, due to the contact with the workpiece, a closed electrical circuit is created for measuring a resistance value, wherein the electric circuit progresses from the measuring and transmission unit via one conductor strand, the workpiece, and the other conductor strand back to the measuring and transmission unit, and the conductor strands are designed in such a way that a measured resistance is dominated by a resistance of conductor strands, so that the measured resistance is a reciprocal proportional measurement for a degree of wear of the head, and wherein the measuring and transmission unit is configured for measuring and transmitting the measured resistance to the control system and wherein the control system is configured for considering the measured resistance in determining whether a predefined surface contour of the workpiece has been achieved.

2. The grinding robot according to claim 1, wherein the conductor strands are insulated in that they are separately arranged from one another.

3. The grinding robot according to claim 1, wherein an electrical insulating material is disposed between the conductor strands.

4. The grinding robot according to claim 3, wherein the conductor strands progress parallel to one another.

5. The grinding robot according to claim 3, wherein the conductor strands progress coaxially, parallel to one another, and wherein one conductor strand is tubular and includes the other conductor strand.

6. The grinding robot according to claim 1, wherein the conductor strands consist of graphite.

7. The grinding robot according to claim 1, wherein the conductor strands consist of carbon fiber.

8. The grinding robot according to claim 1, wherein the measuring and transmission unit includes a battery.

9. The grinding robot according to claim 1, wherein the measuring and transmission unit comprises a super capacitor.

10. The grinding robot according to claim 1, wherein the measuring and transmission unit is configured to transmit the measured resistance to the control system by Bluetooth®.

11. The grinding robot according to claim 1, wherein the grinding wheel includes a disc for measuring bending of the tool receptacle, and the wherein measuring and transmission unit is configured to transmit a measured value of bending to the control system.

12. The grinding robot according to claim 11, wherein the disc which is mounted on the tool receptacle.

13. The grinding robot according to claim 12, wherein the measuring and transmission unit includes at least one sensor which is configured for measuring a distance between the disc and the measuring and transmission unit.

14. A method for grinding an electrically conducting workpiece, comprising:

providing a grinding robot for grinding the electrically conducting workpiece, the grinding robot including a grinding wheel, the grinding wheel including an undulated tool receptacle which defines an axis of rotation about which the grinding wheel can rotate during grinding, a head which is rotationally symmetrical with respect to the axis of rotation, and the head contains abrasive material and has a grinding surface that is configured for contacting the workpiece during grinding, a measuring and transmission unit, and at least one conductor strand pair including two conductor strands which are electrically insulated from one another, the conductor strands are embedded in the head and extend from the grinding surface of the head into an interior of the head and are electrically connected with the measuring and transmission unit, an actuation device for actuating the grinding wheel, and a control system which is connected with the actuation device and which controls the grinding wheel, wherein the conductor strands are arranged in such a way that during grinding, due to the contact with the workpiece, a closed electrical circuit is created for measuring a resistance value, wherein the electric circuit progresses from the measuring and transmission unit via one conductor strand, the workpiece, and the other conductor strand back to the measuring and transmission unit, and the conductor strands are designed in such a way that a measured resistance is dominated by a resistance of conductor strands, so that the measured resistance is a reciprocal proportional measurement for a degree of wear of the head, and wherein the measuring and transmission unit is configured for measuring and transmitting the measured resistance to the control system and wherein the control system is configured for considering the measured resistance in determining whether a predefined surface contour of the workpiece has been achieved;

moving the grinding wheel toward the workpiece until the grinding wheel is in contact with the workpiece; and processing of the workpiece by the grinding wheel until a predefined surface contour on the workpiece is achieved, wherein the control system terminates the moving step and transitions to the processing step as soon as it has received the resistance value from the measuring and transmission unit, and wherein in the processing step the measuring and transmission unit constantly transmits the resistance value to the control system which considers the resistance value in determining whether the predefined surface contour has been achieved.

15. The method according to claim 14, wherein the conductor strands are insulated in that they are separately arranged from one another.

16. The method according to claim 14, wherein an electrical insulating material is disposed between the conductor strands.

17. The method according to claim 14, wherein the conductor strands progress parallel to one another.

18. The method according to claim 17, wherein the conductor strands progress coaxially, parallel to one another, and wherein one conductor strand is tubular and includes the other conductor strand.

19. The method according to claim 14, wherein the grinding wheel includes a disc for measuring bending of the tool receptacle, and the wherein measuring and transmission unit is configured to transmit a measured value of bending to the control system.

20. The method according to claim 19, further including a step of generating an error message by the control system and removing the grinding wheel from the workpiece if, in the moving step, the measuring and transmission unit transmits a measured value of bending that exceeds a predefined value of bending.

* * * * *